United States Patent [19]

Tamaki et al.

[11] 4,247,491

[45] Jan. 27, 1981

[54] ACCELERATOR PUMP FOR CARBURETOR

[75] Inventors: Sigeo Tamaki; Tohru Nakagawa, both of Ibaraki, Japan

[73] Assignee: Hitachi, Ltd., Japan

[21] Appl. No.: 1,313

[22] Filed: Jan. 5, 1979

[30] Foreign Application Priority Data

Jan. 17, 1978 [JP] Japan ..... 53-3571

[51] Int. Cl.[3] ..... F02M 7/08

[52] U.S. Cl. ..... 261/34 A

[58] Field of Search ..... 261/34 A, 34 B, DIG. 38

[56] References Cited

U.S. PATENT DOCUMENTS

| | | | |
|---|---|---|---|
| 2,493,804 | 1/1950 | Carlson | 261/34 A |
| 2,732,193 | 1/1956 | Wentz, Jr. | 261/34 A |
| 2,771,282 | 11/1956 | Olson et al. | 261/34 A |
| 2,785,880 | 3/1957 | Olson | 261/34 A |
| 3,085,515 | 4/1963 | Workman | 261/34 A |
| 3,269,711 | 8/1966 | Baldwin | 261/34 B |
| 3,321,195 | 5/1967 | Korte | 261/DIG. 38 |
| 4,108,951 | 8/1978 | Niwa et al. | 261/34 B |
| 4,130,609 | 12/1978 | Fiedler | 261/34 A |
| 4,157,365 | 6/1979 | Inoue et al. | 261/34 B |

FOREIGN PATENT DOCUMENTS

| | | | |
|---|---|---|---|
| 543249 | 2/1932 | Fed. Rep. of Germany | 261/34 A |
| 579261 | 6/1933 | Fed. Rep. of Germany | 261/34 A |
| 603933 | 10/1934 | Fed. Rep. of Germany | 261/34 A |
| 50/4801 | 2/1975 | Japan | 261/34 B |
| 1413806 | 11/1975 | United Kingdom | 261/34 A |

*Primary Examiner*—Tim R. Miles

*Attorney, Agent, or Firm*—Craig & Antonelli

[57] ABSTRACT

An accelerator pump for a carburetor comprises a piston assembly inserted in a cylindrical well formed in a carburetor body, a link mechanism for actuating the piston assembly in response to movement of a throttle valve, and a tapered stopper. The piston assembly is separated from the link mechanism and engaged with it only when accelerated. The tapered stopper is inserted in a hole made in said carburetor body, which hole is perpendicular to the cylindrical well, passing through a hole made in the piston assembly. A gap defined between the tapered stopper and the periphery portion of the hole of the piston assembly determines the stroke of the piston assembly. Further, the gap is adjusted by axial movement of the tapered stopper. The tapered stopper is locked with sealing material after being adjusted so that any user can not re-adjust the tapered stopper.

9 Claims, 2 Drawing Figures

ACCELERATOR PUMP FOR CARBURETOR

BACKGROUND OF THE INVENTION

This invention relates to improvements to an accelerator pump for a carburetor.

The accelerator pump for the carburetor is provided for obtaining a substantial acceleration of fuel supplied into a main fuel supplying system of the carburetor during acceleration. This accelerator pump comprises a cylinder formed in a carburetor body, a piston assembly slidably inserted in the cylinder, and a link mechanism connected to a throttle valve for actuating the piston assembly. An amount of fuel supplied during acceleration is determined by a stroke of the piston assembly made by movement of the link mechanism during acceleration, therefore, it is necessary to adjust the stroke precisely. When an excess amount of fuel is supplied the acceleration is increased, but, an amount of CO in the exhaust gas increases. If a user deforms the link mechanism to provide a larger stroke in order to obtain greater acceleration beyond that achievable with factory settings, there will be produced an increase in the amount of harmfull components in the exhaust gas. Re-adjustments by the user which would increase the stroke of the piston must be prevented if environmental exhaust gas requirements are to be met. Therefore, some measurement of preventing such a readjustment has been desired.

On the other hand, in Japanese patent publication No. 4801/1975 disclosed in an accelerator pump which is provided with a stopper 7 provided on a heat sensitive liquid 8 contained in a cavity formed in a lower portion of a pump chamber for keeping a quantity of fuel supplied during acceleration constant irrespectively of temperature changing. In this accelerator pump, it is apparent that a stroke of an accelerating piston 6 can be changed by deformation of a link mechanism (not shown) because elevation of the accelerating piston 6 is determined by the link mechanism. Therefore, even if such a stopper 7 is provided, any kind of stroke can be obtained by deforming the link mechanism.

SUMMARY OF THE INVENTION

An object of the invention is to provide an accelerator pump for a carburetor, in which a quantity of fuel supplied during acceleration does not exceed a predetermined value even if a link means for actuating the accelerator pump is deformed in any shape.

Another object of the invention is to provide an accelerator pump for a carburetor, in which a piston stroke of the accelerator pump can be adjusted precisely from the outside of the carburetor without disassembling the accelerator pump or the carburetor, and the piston stroke is not adjusted to be larger by a user.

Briefly stated, a feature of the invention is that means for restricting the stroke of piston means to a predetermined extent is provided in a carburetor body, and the means for restricting the stroke is locked so that the means for restricting the stroke will not be operated by any user.

DETAILED DESCRIPTION OF THE PREFERRED EMBODIMENT

Figure 1:
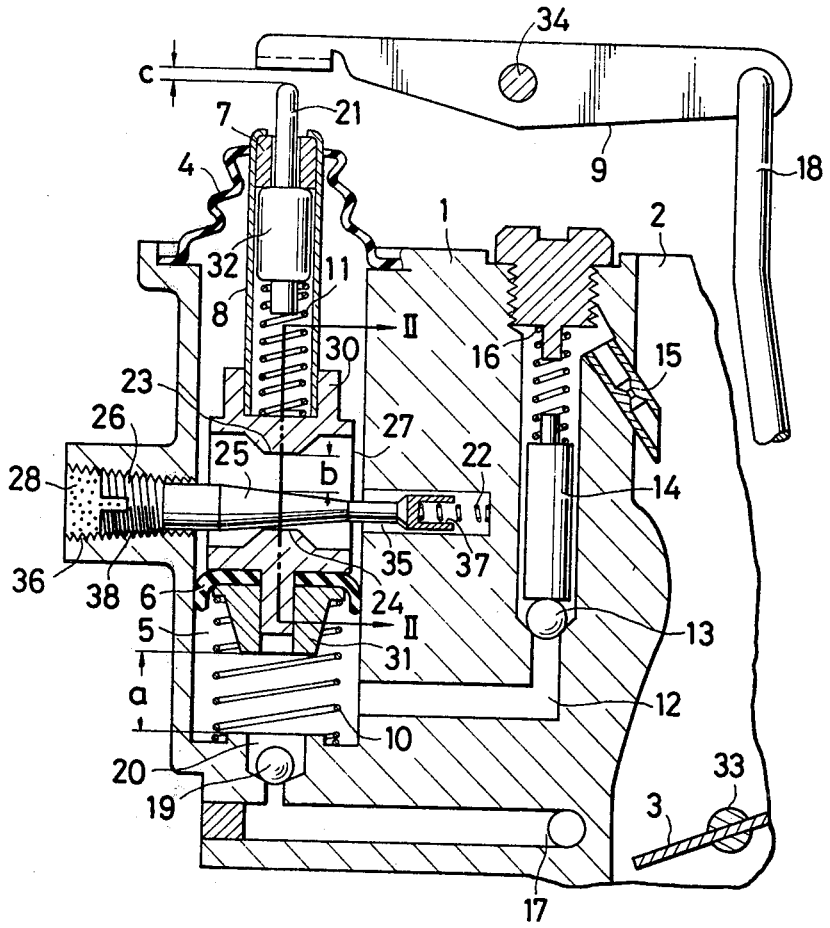
FIG. 1 is a section view of an embodiment of an accelerator pump for a carburetor according to the invention.
Figure 2:
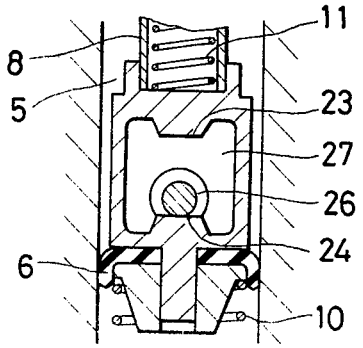
FIG. 2 is a section view taken along a line II—II of FIG. 1.

Referring to FIG. 1, an embodiment of an accelerator pump for a carburetor according to the invention will be described hereinafter in detail.

In FIG. 1, a carburetor body 1 has an induction passage 2 provided with a throttle valve 3. In the induction passage upstream of the throttle valve 3, an injector 15 is provided for injecting fuel into the induction passage 2 during acceleration. The carburetor body 1 has a cylinder or cylindrical well 5 formed therein. In the cylinder 5, a piston 6 made of rubber, leather or the like is slidably inserted. The piston 6 is rigidly held between a supporting member 30 and a securing member 31. The supporting member 30 is secured to a cylindrical rod guide 8, the top portion of which is supported by a flexible cover 4 secured to the carburetor body 1 and has a cylindrical stopper 7 secured to the inside of the rod guide 8. In the rod guide 8, a damper spring 11 and a piston pin 21 are inserted. The piston pin 21, which has a guide portion 32 of larger diameter than the other, is urged upward by the damper spring 11 and restrained by the stopper 7. The top of the piston pin 21 faces an end of a pump lever 9 with a distance C. The other end of the pump lever 9 is connected to the throttle valve 3 through a pump rod 18 and a shaft 33. In a lower portion of the cylinder 5, a return spring 10, the spring force of which is not stronger than that of the damper spring 11, is inserted to urge the piston upward. In the bottom of the cylinder 5, a recess 20 is formed in which a check ball 19 is inserted to provide a check valve. The recess 20 communicates with a float chamber (not shown) through a fuel passage 17. Further, another bottom portion of the cylinder 5 communicates with the injector 15 through an accelerating fuel passage 12, in the vertical part of which a check valve comprising a ball 13, a weight 14, and a spring 16 is inserted.

The supporting member 30 has a horizontal bore 27 formed therein. In the horizontal bore 27, there are provided an upper projection 23 and lower projection 24. In the carburetor body 1, a hole 35 substantially perpendicular to the cylinder 5 is formed in alignment with the horizontal bore 27 of the supporting member 30. An inlet portion 36 of the hole 35, which is open to atmosphere, is larger in diameter than the opposite portion and is threaded. In the hole 35, a stopper 26 having a tapered portion 25 and a screw portion 38 is inserted and screwed so as to pass through the bore 27. The end of the stopper 26 which is smaller in diameter has a small cylindrical recess 37 in which a compression spring 22 is disposed to cause rotating friction of the stopper 26. The stopper 26 is axially moved by rotating it with a tool such as a screwdriver to adjust a distance (b) between the lower portion of the upper projection 23 and the upper surface of the stopper 26. After the distance (b) is adjusted to a proper value, sealing material such as adhesive agent is filled in the screw portion so that any user can not readjust the stopper 25.

The piston pin 21 is separated from the pump lever 9, and even if the piston pin 21 is raised to the limit, the distance C between the piston pin 21 and the end of the lever 9 is kept when the throttle valve 3 is not in an accelerating position.

In an accelerator pump constructed as noted above, when a driver or operator steps on an accelerator at a time of acceleration, the pump rod 18 is pushed up to lower the end of the pump lever 9 facing the piston pin 21. At this time, the end of the pump lever 9 pushes down the piston pin 21, whereby a piston assembly comprising the piston pin 21, the piston rod guide 8, the damper spring 11, the supporting member 30, the piston 6 and the securing member 31, is lowered against the return spring 10. The downward movement of the piston 6 or the piston assembly is stopped by the stopper 26 when the upper projection 23 of the supporting member 30 moves downward by the distance (b) and contacts with the upper face of the stopper 26. Fuel in the cylinder 5 is injected by an amount corresponding to the downward movement of the piston 6 from the injector through the fuel passage 12. An amount of the descending distance (b) is determined to be smaller than a distance (a) between the bottom of the cylindrical well 5 and lower face of the securing member 31.

After the acceleration, as the driver decreases the degree to which the accelerator pedal is depressed, the pump lever 9 is moved toward the original position in which the accelerator is not stepped on so that the piston pin 21 will be raised while moving in the rod guide 8 until the upward movement of the piston pin 21 is restrainted by the stopper 7, and then the piston assembly is further raised by the return spring 10 until its movement is restrainted by the stopper 26. Upon the upward movement of the piston assembly, pressure in the cylinder bottom decreases and fuel is supplied therein from the float chamber through the fuel passage 17 and the check valve.

In this accelerator pump, if a user or driver deforms the pump rod 18 to reduce its length so that the distance C will be larger, the downward movement of the piston 6 during acceleration may be smaller than the distance (b). Therefore, an amount of fuel injected from the injector 15 may decrease. On the contrary, when the pump rod is lengthened so that the distance C will be shortened, the downward movement of the piston 6 is not effected above the distance (b) because of the restriction by the tapered portion of the stopper 26 so that fuel for acceleration will not be increased. Namely, however a user deforms or reduces the pump rod 18, the fuel for acceleration is not increased even if fuel may decrease.

By rotating the stopper 26 to change the position that the stopper 26 contacts with the supporting member 31, it is possible to adjust an amount of fuel supplied for acceleration. However, the stopper 26 is locked by the sealing material after adjusted to be suitable for purification of exhaust gas, whereby the adjustment of the stopper 26 by a user can not be effected practically.

As above-mentioned, the accelerator pump according to the invention has an effect that an amount of fuel for acceleration injected by the accelerator pump is restricted not to exceed a limited value, even if a user deforms a link mechanism for operating the accelerator pump, such as the pump rod 18. Further, the stopper 26 can not be adjusted by the user, because of the sealing material applied thereto. Therefore, harmfull components in the exhaust gas are not increased.

What is claimed is

1. An accelerator pump for a carburetor having therein a fuel-air-induction passage and a throttle valve disposed in the fuel-air induction passage comprising:

means defining a cylinder in the carburetor;

a piston assembly slidably inserted in said cylinder thereby forming an expansible chamber in cooperation with said cylinder;

means for urging said piston assembly upward so that said expansible chamber will be expanded;

a first fuel passage for conveying fuel from a fuel source to said expansible chamber according to expansion of said expansible chamber;

a second fuel passage for conveying fuel from said expansible chamber to the fuel-air induction passage according to shrinkage of said expansible chamber;

link means mechanically connected to said throttle valve for actuating said piston assembly to cause a stroke of said piston assembly only at a time of acceleration;

stopper means separated from said link means for controlling the quantity of fuel conveyed to said second fuel passage during a stroke of said piston assembly to a predetermined quantity by setting both the upper and lower limits of said stroke in a manner whereby said quantity will not be made larger than the predetermined quantity by any deformation of said link means; and means for preventing unauthorized adjustment of said stopper means.

2. The accelerator pump as defined in claim 1, wherein said stopper means includes a part of said piston assembly defining a hole perpendicular to said cylinder, and a tapering member passing through said hole and supported by said means defining said cylinder, said predetermined stroke being equal to a gap defined between said tapering member and said part of said piston assembly with respect to said stroke.

3. The accelerator pump as defined in claim 1 or 2, wherein the top of said piston assembly is spaced from said link means, and engaged with said link means only at a time of acceleration.

4. The accelerator pump as defined in claim 3, wherein said piston assembly comprises a piston, a supporting member for supporting said piston, a hollow piston rod guide secured to said supporting member, a compression spring inserted in said hollow piston rod guide, a piston pin inserted in said hollow piston rod guide and urged upward by said compression spring, and a cylindrical stopper secured to said hollow piston rod guide for preventing upward movement of said piston pin, said piston pin having a portion which is extended out of said hollow piston rod guide when restrained by said cylindrical stopper and which faces said link means so as to engage with said link means only at a time of acceleration.

5. The accelerator pump as defined in claim 4, wherein said stopper means comprises a part of a carburetor body in which a hole perpendicular to said cylinder is formed, a pair of projections provided in a hole made in said supporting member so as to align vertically with a gap therebetween, and a tapered stopper inserted in said hole of said carburetor body so as to pass through between said pair of projections, said pair of projections determining the entire stroke of said piston assembly.

6. An accelerator pump for a carburetor having a fuel-air induction passage formed in a carburetor body and a throttle valve disposed in the fuel-air induction passage comprising:

pumping means provided in the carburetory body and having piston means for supplying fuel from a float chamber into the fuel-air induction passage in response to movement of a link means mechanically connected to the throttle valve during acceleration;

stopper means provided in the carburetor body for determining the upper and lower extent of the stroke of said piston means, said stopper means being independent of said link means;

means comprising parts of said carburetor body and said stopper means and opened to atmosphere for adjusting said stopper means so that the stroke of said piston means will be suitable for supplying a desired quantity of fuel into the fuel-air induction passage during acceleration; and means for locking said stopper means after adjusting said restricting means thereby preventing unauthorized adjustment of said stopper means.

7. The accelerator pump as defined in claim 6, wherein said piston means has a portion separated from said link means and engaged with said link means during the acceleration.

8. An accelerator pump for a carburetor having a fuel-air induction passage formed in a carburetor body and a throttle valve disposed in the fuel-air induction passage comprising:

pumping means provided in the carburetor body and having piston means for supplying fuel from a float chamber into the fuel-air induction passage by a stroke of said piston means in response to movement of a link means mechanically connected to the throttle valve during acceleration;

and an abutment element mounted in association with said piston means and independent of said link means for setting both the upper and lower limits of the stroke of the piston means, whereby the stroke of said piston means cannot be increased by adjustments made to said link means, wherein said abutment means is adjustably mounted internally of said carburetor body, and further comprising means for preventing unauthorized access to said abutment element.

9. An accelerator pump according to claim 8, wherein said abutment element extends into said pumping means and wherein said piston means is provided with upper and lower surface portions disposed on opposite sides of said abutment element, said upper and lower surface portions engaging said abutment to set said lower and upper stroke limits, respectively.

* * * * *